United States Patent [19]

Chellis, deceased et al.

[11] Patent Number: 4,466,251

[45] Date of Patent: Aug. 21, 1984

[54] FLUID ACTUATOR FOR CRYOGENIC VALVE

[75] Inventors: Fred F. Chellis, deceased, late of Concord, Mass., by June M. Chellis, executrix; Philip A. Lessard, Acton, Mass.

[73] Assignee: Helix Technology Corporation, Waltham, Mass.

[21] Appl. No.: 351,523

[22] Filed: Feb. 23, 1982

[51] Int. Cl.[3] ..... F25B 9/00

[52] U.S. Cl. ..... 62/6; 62/513; 60/520; 137/340

[58] Field of Search ..... 62/6, 513; 60/520; 137/340

[56] References Cited

U.S. PATENT DOCUMENTS

| | | | |
|---|---|---|---|
| 2,836,964 | 6/1958 | Roozendaal et al. | 62/6 |
| 3,007,493 | 11/1961 | Viale et al. | 137/623 |
| 3,036,427 | 5/1962 | Meijer | 62/6 |
| 3,188,821 | 6/1965 | Chellis | 62/6 |
| 3,274,781 | 9/1966 | Morain et al. | 60/64 |
| 3,360,955 | 1/1968 | Witter | 62/335 |
| 3,438,220 | 4/1969 | Collins | 23/285 |
| 3,466,867 | 9/1969 | Brandes | 62/6 |
| 3,574,998 | 4/1971 | Bredow | 60/36 |
| 3,991,586 | 11/1976 | Acord | 62/520 |
| 4,087,988 | 5/1978 | Pallaver et al. | 62/514 |

OTHER PUBLICATIONS

Numatics Inc., Highland, Michigan 48031, brochure for Mark 1 TM, 1978.

Patton, G., G. Green, K. Dunn, V. Dilling, "Hydraulically Controlled Helium Expansion Engine," *Advances in Cryogenic Engineering*, vol. 27, 1982, pp. 641–648.

Johnson, R. W., S. C. Collins and J. L. Smith, Jr., "Hydraulically Operated Two-Phase Helium Expansion Engine," *Advances in Cryogenic Engineering*, vol. 16, pp. 171–177.

Kneuer, R., K. Petersen and A. Stephan, "Automatic Multi-Range Helium Liquefaction Plant," *Cryogenics*, Mar. 1980, pp. 129–132.

Fitch, E. C., J. B. Surjaatmadja, "Introduction to Fluid Logic," pp. 52, 133 and 58.

*Primary Examiner*—Ronald C. Capossela

*Attorney, Agent, or Firm*—Hamilton, Brook, Smith & Reynolds

[57] ABSTRACT

Valves for controlling process gas at the cold end of an expansion engine are fluid actuated. The actuating fluid is controlled by a solenoid actuated spool valve positioned at ambient temperature. The fluid is cooled in a thermally regenerative flow path extending between the solenoid actuated valve and the fluid actuated valve.

8 Claims, 2 Drawing Figures

FLUID ACTUATOR FOR CRYOGENIC VALVE

DESCRIPTION

TECHNICAL FIELD

This invention relates to the actuation of valves positioned in the cold environment of a refrigerator and has particular application to cryogenic expansion engines.

BACKGROUND

A typical expansion engine used in cryogenic refrigeration is shown in U.S. Pat. No. 3,438,220 to Collins. In such refrigerators, a piston reciprocates within a cylinder which has a cold end positioned within a cold, insulated environment. High pressure gas such as helium, already cooled in a heat exchanger, is introduced into the cold end of the cylinder by a first valve. With upward movement of the piston, that cold gas is expanded and thus further cooled and is then exhausted through a second valve. The exhausted gas is returned to ambient temperature through the heat exchanger to cool the incoming high pressure gas. With such an arrangement, the high pressure and exhaust valve are positioned in the cold enviornment. Typically, the valves are controlled by long valve rods which extend through the insulation to ambient. The valve rods are typically driven by cams associated with the piston drive.

It is often desirable to control the valves electrically as by a solenoid rather than by the mechanical cams used in the above-mentioned Collins patent. However, due to the extended length of the valve rods from the cold environment to ambient, a solenoid positioned at ambient acting directly on a valve rod would necessarily be large. To avoid that problem, Johnson et al., in "Hydraulically Operated Two-Phase Helium Expansion Engine," *Advances In Cryogenic Engineering,* Vol 16, Proceedings of the 1970 Cryogenic Engineering Conference, pp 171–77, have used a pneumatic actuator positioned at the ambient end of the valve rods. The actuating fluid is in turn controlled by a solenoid actuated valve. Although this arrangement allows for the use of much smaller solenoid valves, it still requires valve rods of extended length which must be carefully designed to prevent conduction of heat through those valves to the cold end. Further, the length of the valve rods makes alignment of parts at each end of the rod more difficult.

In another approach described by Kneuer et al., "Automatic Multi-Range Helium-Liquefaction Plant", Cryogenics, March 1980, pp 129–132, the solenoids are positioned at the cold end of the expansion engine adjacent to the valves. This presents considerable thermal problems, however, because the solenoids generate heat which must be removed from that cold end of the system. Further, because high pressure process gases are controlled by the valves, solenoids acting directly on those valves are relatively large.

An object of this invention is to provide means for actuating valves positioned at the cold end of a refrigerator which minimize mechanical complications and thermal lossses from the cold end while enabling the use of an electrically controlled device as the initial controller.

Disclosure of the Invention

A fluid actuated valve is positioned within a cold region of a refrigerator. The control fluid to that valve is cooled by a thermal regenerator. As that control fluid is exhausted from the valve, heat is restored to the fluid by the regenerator.

In the preferred form of the invention, a solenoid actuated spool valve positioned at ambient temperature controls the flow of control fluid to the regenerator.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

PREFERRED EMBODIMENT OF THE INVENTION

Figure 1:
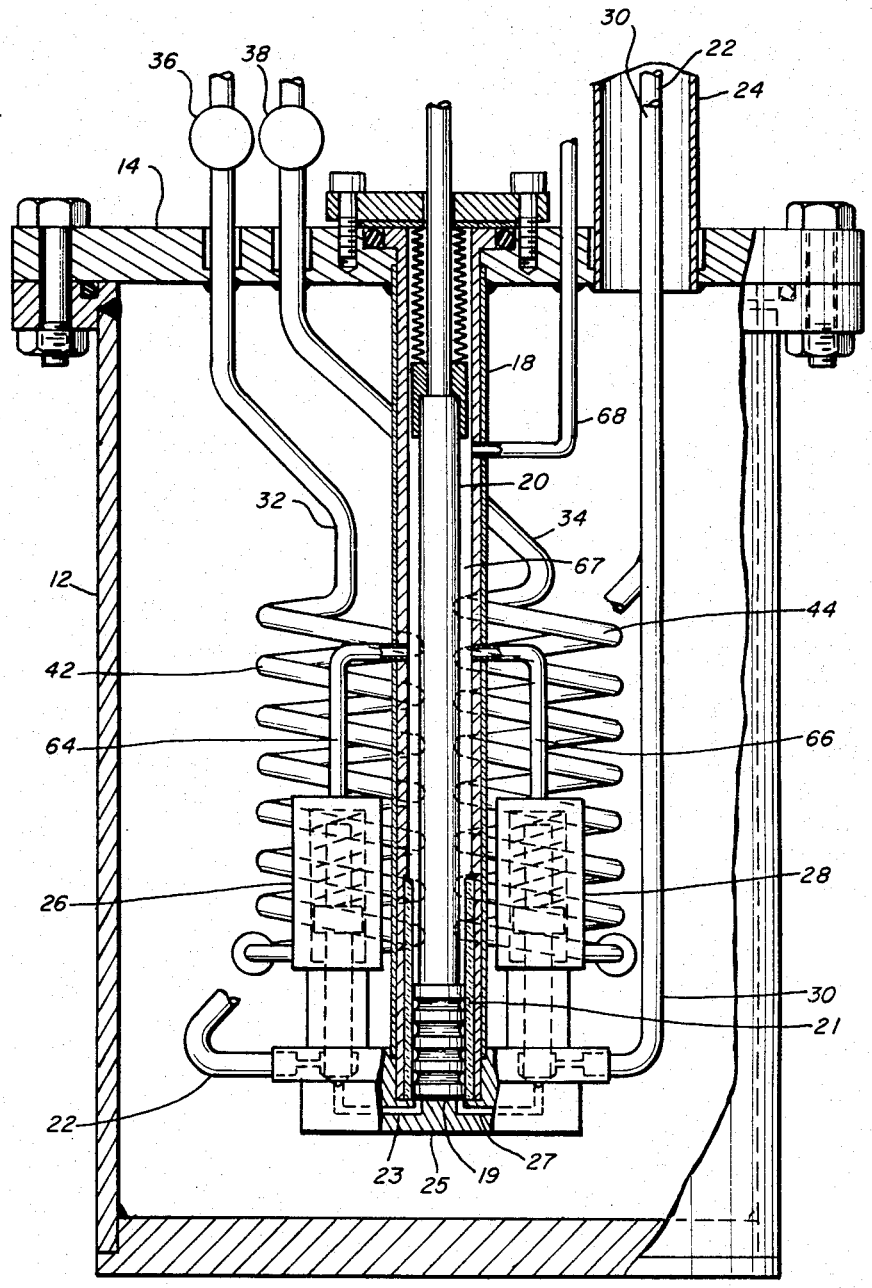
FIG. 1 is a view of an expansion engine having valves at its cold end controlled in accordance with principles of this invention.

As shown in FIG. 1, an expansion engine assembly is housed in a vacuum jacket 12 which is suspended from a cover plate 14. The cover plate is mounted to the outer housing of a refrigeration system and is at ambient temperature. An expansion engine cylinder 18 extends into the vacuum jacket through the center of the plate 14. A piston 19 within that cylinder is driven continuously in a reciprocating movement by piston rod 20. The piston 19 is ceramic, such as alumina, and is positioned within a ceramic sleeve 21 in the cylinder 18. The ceramic piston and sleeve form a clearance seal along the piston. Annular grooves are formed in the piston to minimize pressure differentials which might cause the piston to bind within the cylinder.

High pressure process gas such as helium is introduced into this expansion engine through a tube 22. This tube carries cold process gas from heat exchangers (not shown) through a vacuum insulated delivery tube 24. The cold high pressure process gas from tube 22 is valved into the lower, cold end of the expansion engine by way of a valve 26 at that cold end. The valve 26 opens as the piston begins moving upward from its lowermost end. The process gas then passes into the cold end of the cylinder through a bore 23 in an end plate 25.

With further upward movement of the piston, the high pressure gas in the cylinder is expanded and thus further cooled. Then, as the piston is returned in a downward stroke the valve 28 opens to exhaust the cold low pressure process gas through a bore 27 and tube 30 back through the delivery tube 24.

Figure 2:
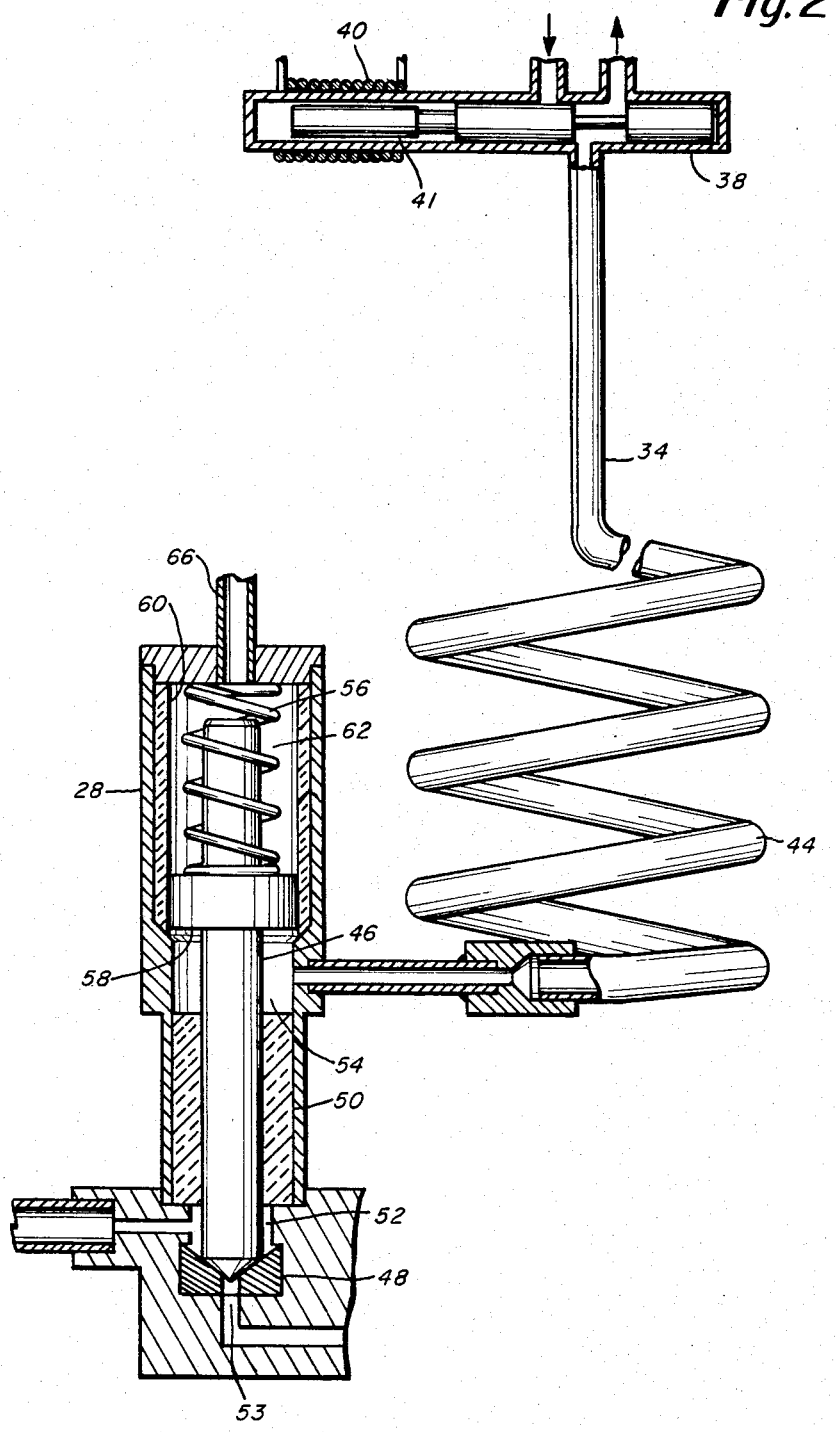
FIG. 2 is an enlarged cross sectional view of a cold end fluid actuated valve and a warm end solenoid actuated valve in FIG. 1.

In accordance with this invention, the valves 26 and 28 are fluid actuated. The actuating fluid is preferably the same fluid as the process fluid to prevent contamination. It is introduced into and exhausted from those valves through respective tubes 32 and 34. That actuating gas is itself controlled by solenoid spool valves 36 and 38 positioned at ambient. For example, the valve 38 shown in section in FIG. 2 is positioned to exhaust the actuating gas from tube 34 and thus close the valve 28. When the solenoid 40 is energized to pull the spool 41 to the left, the exhaust is closed and high pressure gas is admitted to the tube 44 to open the valve 28.

Details of a fluid actuated valve at the cold end of the expansion engine are also shown in FIG. 2. The valve 28 is shown in its closed position with the valve element 46 resting against a valve seat 48. The valve element 46 and an associated ceramic sleeve 50 are close fitting ceramic pieces which form a clearance seal between the process gas volume 52 and the actuating gas volume 54. The valve element 46 is held down against the valve seat 48 by a spring 56 which is sufficiently strong to overcome the upward force presented by the high pressure process gas in the volume 53. When high pressure gas is introduced into the volume 54 it presses upward on the surface 58 of the valve against this spring 56 to pull the valve away from the seat 48. Another ceramic sleeve 60 and the valve element 46 provide a clearance seal between the volume 54 and a vented volume 62. The respective valves 26 and 28 are vented through tubes 64 and 66 to the space 67 between piston rod 20 and cylinder 18. In that way, the cold vented gas can be used to minimize heat flux downward through the expansion engine cylinder. Eventually the vent gas exits warm via return tube 68.

With the valves 26 and 28 actuated only indirectly by the solenoids, the solenoids can be of minimal size. Further, because the solenoids are positioned at ambient temperature, heat generated by the solenoids does not interfere with refrigeration at the cold end of the expansion engine.

With a simple conduit between solenoid actuated valves 36 and 38 and the fluid actuated valves 26 and 28 the actuating gas itself would be a source of heat to the cold end of the expansion engine. In accordance with this invention, to maximize the temperature gradient along the length of the tubes 32 and 34 and thus minimize heat flow to the cold valves by the actuating gas, the tubes 32 and 34 are filled with thermally regenerative material such as nickel or lead beads or copper screen. As the high pressure actuating gas passes downward through those tubes, heat from the gas is stored in the regenerator so that upon reaching the valves at the cold end the gas is at the same low temperature. Then, as the gas is exhausted back through the regenerators the heat is returned to the gas to cool down the regenerative material in preparation for the next cycle. To increase the length of the regenerators for providing a maximum temperature gradient, the regenerator tubes are coiled at 42 and 44.

While the invention has been particularly shown and described with reference to a preferred embodiment thereof, it will be understood by those skilled in the art that various changes in form and details may be made therein without departing from the spirit and scope of the invention as defined by the appended claims.

We claim:

1. In a refrigerator having a valve operating at cold temperatures, a valve and actuator characterized by:

a fluid actuated valve at said cold temperature;

control means operating at a temperature above said cold temperature for controlling a valve actuating fluid; and a thermally regenerative actuating-fluid flow path between the valve and control means for cooling fluid directed to the valve and reheating that fluid as it is exhausted from the valve.

2. A valve and actuator as claimed in claim 1 further comprising means responding to an electrical signal to control the introduction of actuating fluid into the thermally regenerative flow path.

3. A valve and actuator as claimed in claim 2 wherein the electrically responsive control means is a solenoid actuated valve.

4. A valve and actuator as claimed in claim 3 wherein the solenoid actuated valve is a spool valve.

5. An expansion engine refrigerator comprising a reciprocating piston within a cylinder and at least one process gas control valve operating at the cold end of the cylinder, the valve and its actuator characterized by:

a fluid actuated valve at said cold temperature;

control means operating at a temperature above said cold temperature for controlling a valve actuating fluid; and a thermally regenerative actuating-fluid flow path between the valve and control means for cooling fluid directed to the valve and reheating that fluid as it is exhausted from the valve.

6. An expansion engine refrigerator comprising a reciprocating piston within a cylinder and at least one process gas control valve operating at the cold end of the cylinder, the valve and its actuator characterized by:

a fluid actuated valve at said cold temperature;

solenoid actuated control means operating at a temperature above said cold temperature for controlling a valve actuating fluid; and a thermally regenerative actuating-fluid flow path between the valve and control means for cooling fluid directed to the valve and reheating that fluid as it is exhausted from the valve.

7. A method of controlling a fluid actuated valve operating at a cold temperature comprising:

controlling a valve actuating fluid by control means operating at a temperature above said cold temperature, directing the valve actuating fluid from the control means to the valve while cooling the actuating fluid by means of a thermal regenerator, actuating the valve with the cooled actuating fluid, and restoring heat from the thermal regenerator to the actuating fluid as it is exhausted from the valve.

8. A method as claimed in claim 7 wherein the actuating fluid is controlled by a solenoid actuated valve.

* * * * *